United States Patent [19]

Gailey et al.

[11] 4,364,215

[45] Dec. 21, 1982

[54] SUSPENDED CEILING ASSEMBLY AND STABILIZER BAR THEREFOR

[75] Inventors: J. Lynn Gailey, Newton Falls; Carl A. Wollam, Cortland, both of Ohio

[73] Assignee: Alcan Aluminum Corporation, Cleveland, Ohio

[21] Appl. No.: 160,633

[22] Filed: Jun. 18, 1980

[51] Int. Cl.[3] ..... E04B 5/52

[52] U.S. Cl. ..... 52/488; 52/667; 403/347

[58] Field of Search ..... 52/488, 473, 507, 667; 403/347, 346, 253

[56] References Cited

U.S. PATENT DOCUMENTS

| | | | |
|---|---|---|---|
| 2,210,516 | 8/1940 | Wheeler | 52/473 |
| 3,153,294 | 10/1964 | Hay | 403/252 |
| 3,394,518 | 7/1968 | Worrell | 52/473 |
| 3,755,988 | 9/1973 | Slays | 52/473 |
| 4,062,301 | 12/1977 | Pitchford | 52/667 |
| 4,064,671 | 12/1977 | Sauer | 52/488 |
| 4,068,438 | 1/1978 | Nute | 52/488 |
| 4,208,851 | 6/1980 | Sauer | 52/667 |
| 4,264,231 | 4/1981 | Rosenbaum | 52/667 |

*Primary Examiner*—Price C. Faw, Jr.
*Assistant Examiner*—Henry E. Raduazo
*Attorney, Agent, or Firm*—Cooper, Dunham, Clark, Griffin & Moran

[57] ABSTRACT

In a suspended ceiling assembly of panels carried by spaced, elongated stringers, stabilizer bars interconnecting the stringers for maintaining the stringers fixed in position relative to each other and preventing racking of the assembly. Each stabilizer bar is a rigid element having a tab at each end for snap-fitting insertion into a slot formed in a stringer, and also having flange portions adjacent each end for bearing against a stringer surface along spaced extended lines of contact, when the tab at that end is inserted in the stringer, to prevent angular movement of the stringer relative to the stabilizer bar.

13 Claims, 7 Drawing Figures

Fig. 6.
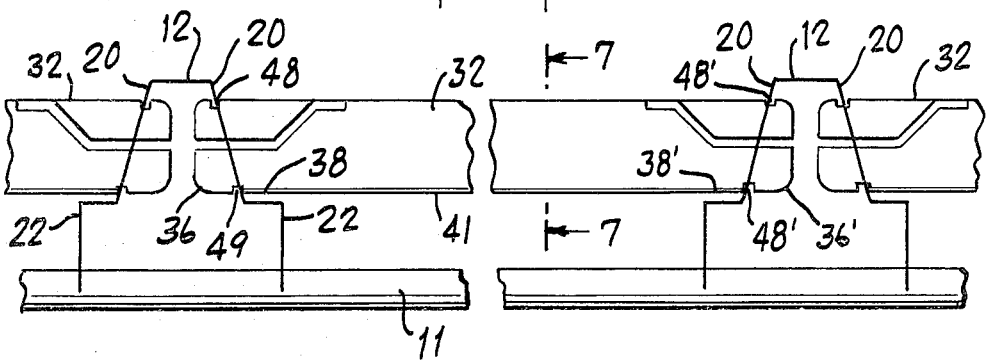
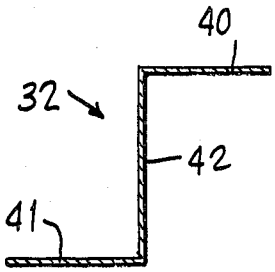
Fig. 7.

SUSPENDED CEILING ASSEMBLY AND STABILIZER BAR THEREFOR

DESCRIPTION

BACKGROUND OF THE INVENTION

This invention relates to suspended ceilings of the type wherein a plurality of spaced, elongated, individually suspended stringers cooperatively carry an array of ceiling panels. More particularly, it is directed to stabilizer bars for interconnecting adjacent stringers of a suspended ceiling, as well as to ceiling assemblies including such stabilizer bars.

A typical conventional subceiling or suspended ceiling, as frequently provided in a room for aesthetic and/or other reasons, is constituted of an array of ceiling panels spaced some distance below the true structural ceiling of the room. Commonly, the panels of the subceiling are supported by a plurality of elongated carriers or stringers, which are elongated rigid members extending above the panels in spaced relation to each other and are themselves individually suspended from the structural ceiling by wires or rods located at intervals along their lengths. In an illustrative known form of suspended ceiling, to which detailed reference will be made herein for purposes of illustration, the ceiling panels are elongated metal or like resiliently deformable elements of upwardly opening C-shaped cross section, disposed in closely spaced parallel array with their downwardly-facing major surfaces in a common horizontal plane; the stringers supporting them are downwardly-opening horizontally elongated metal channel members each having a plurality of paired downwardly projecting seats on which the panels are snap-fitted. These stringers extend transversely of the panels, being individually suspended at a common elevation in widely spaced parallel relation to each other, so that each stringer supports a large number of the panels and each panel is supported by a plurality of the stringers.

The individual suspension of the stringers in the assembly just described ordinarily permits them some freedom of travel and angular movement. Accordingly, they are liable to become displaced out of strict parallelism with each other, during or even after installation of the panels. Such deviation of the stringers from parallelism hinders panel installation, and if it occurs when the panels are already in place, may cause distortion or dislodgment of panels or at least produce a corresponding and aesthetically undesirable nonparallel orientation of the panels. In addition, the ceiling assembly may undergo racking, which involves a more or less concerted angular (swinging) movement of the stringers again tending to result in misalignment, distortion and/or dislodgment of the panels. Further problems are encountered in assemblies wherein the stringers support structures such as lighting fixtures or heating, ventilating and air conditioning diffusers as well as the panels; if the load imposed on a stringer by one of these structures is eccentric, it can cause rotational movement of the stringer with like objectionable consequences.

Although movement of the stringers can be reduced by anchoring their opposite ends to the opposed walls of a room, it is often not feasible or not convenient to do so, and even if the stringer ends are thus anchored, their intermediate portions may not be adequately restrained from moving, especially when (as is frequently the case) the stringers are many feet in length. It has been proposed to provide cross members or spacer bars between adjacent stringers, to hold them in properly parallel relation to each other, but these previously proposed members or bars have, in general, not been arranged to prevent angular movement such as racking, and/or have been complex in structure or difficult to install.

SUMMARY OF THE INVENTION

The present invention broadly contemplates the provision, in a suspended ceiling assembly including an array of ceiling panels and a plurality of individually suspended, spaced, elongated stringers cooperatively carrying the array of panels, of a plurality of stabilizer bars interconnecting stringers of the assembly for cooperatively maintaining the stringers fixed in orientation relative to each other and for preventing racking of the assembly, each of the stabilizer bars interconnecting two adjacent stringers, and each two adjacent stringers being connected by at least two of the stabilizer bars. In accordance with the invention, each of the stabilizer bars comprises a rigid elongated element having opposed ends and dimensioned to extend between two adjacent stringers respectively disposed at the ends of the element; first and second interlocking means respectively formed at the ends of the element for respectively snap-fittingly engaging the two last-mentioned stringers to hold the element against longitudinal movement relative thereto; and first and second means respectively formed adjacent the ends of the element for respectively bearing against the two last-mentioned stringers, upon engagement of the interlocking means with the last-mentioned stringers, to prevent relative angular movement of the stringers and the element. Each of these bearing means is a means for bearing, along spaced extended lines of contact, against a surface of the stringer disposed at the end of the element adjacent thereto.

As incorporated in ceiling assemblies wherein each of the stringers has a longitudinally extending flat web portion facing an adjacent other one of the stringers (e.g. wherein the stringers are channel members, the side walls of which are such web portions), the invention further contemplates the provision of transversely extending closed-ended slots of predetermined length formed in the web portions of the stringers. For use with such slotted stringers, as a particular feature of the invention, each of the interlocking means of each stabilizer bar is a bifurcated planar tab insertable in one of the slots with the width of the tab aligned with the slot length. The tab is resiliently compressible from an uncompressed width greater than the predetermined slot length to a compressed width permitting insertion of the tab into one of the slots, and has opposed side edge portions for respectively engaging opposite ends of a slot, upon insertion of the tab therein and release of the inserted tab from compression, to lock the tab in the slot. Additionally, each of the bearing means of each stabilizer bar comprises a pair of flanges respectively having edges disposed, adjacent the opposed side edge portions of one of the tabs, to simultaneously abut a surface of one of the stringer web portions adjacent opposite ends of one of the slots, along lines of contact extending transversely of the length of the slot, upon insertion and locking of the tab in the last-mentioned slot.

In assemblies wherein the stringers are oriented with their long dimensions horizontal and are individually suspended at a common elevation in parallel relation to each other, the flat web portions of the stringers being oriented at a substantial angle to the horizontal and extending longitudinally above the panels, the closed-ended slots in accordance with the invention are so disposed that respective slots of two adjacent stringers are aligned in a vertical plane that contains the long dimensions of the slots and is perpendicular to the long dimensions of the two stringers; and the aforementioned element of each stabilizer bar is rectilinear and is dimensioned to extend between two adjacent stringers such that aligned respective slots of the two stringers are respectively disposed at the ends of the element, each of the tabs being snap-fittingly insertable into a stringer slot disposed at the end of the element at which the tab is formed.

A preferred embodiment of the stabilizer bar of the invention, for use in such assemblies, includes a rectilinear element comprising a pair of vertically spaced horizontal longitudinal flanges each having opposite ends and a vertical planar web extending between and integral with said flanges, the vertical web having opposed end portions respectively projecting longitudinally beyond the opposite ends of the flanges. Advantageously, this element is a formed unitary metal bar having a Z-shaped cross-section. Each projecting portion of the vertical web constitutes one of the tabs, and is bifurcated by a slot extending horizontally inwardly from the extremity of the projecting portion, then extending diagonally and inwardly to a juncture between the vertical web and one of the horizontal flanges, and then horizontally inwardly along that juncture, so that the tab is compressible by manual pressure exerted on the horizontal flanges adjacent the projecting portion; the aforementioned opposed side edge portions of each tab are oppositely opening notches for respectively receiving opposite ends of one of the stringer slots when the tab, inserted therein, is released from compression. Each bearing means of the bar, i.e. each of the pairs of flanges respectively formed adjacent each end of the element, comprises end portions of the pair of horizontal longitudinal flanges.

The described stabilizer bars of the invention are structurally simple, readily fabricated, economical and easily installed members for enhancing ceiling system stability by maintaining parallelism of stringers while also preventing racking movement of the stringers. Additionally, they enable the stringers to support eccentric loads without rotating, and can even support loads themselves. Very advantageously, they are capable of use with existing types of suspended ceiling systems, requiring no modification of such systems other than the provision of slots in the stringer webs.

Further features and advantages of the invention will be apparent from the detailed description hereinbelow set forth, together with the accompanying drawings.

BRIEF DESCRIPTION OF THE DRAWINGS

FIG. 6 is a fragmentary elevational sectional view of the assembly of FIG. 1; and FIG. 7 is an enlarged sectional view of one of the stabilizer bars, taken as along the line 7—7 of FIG. 6.

DETAILED DESCRIPTION

Figures 1, 2:
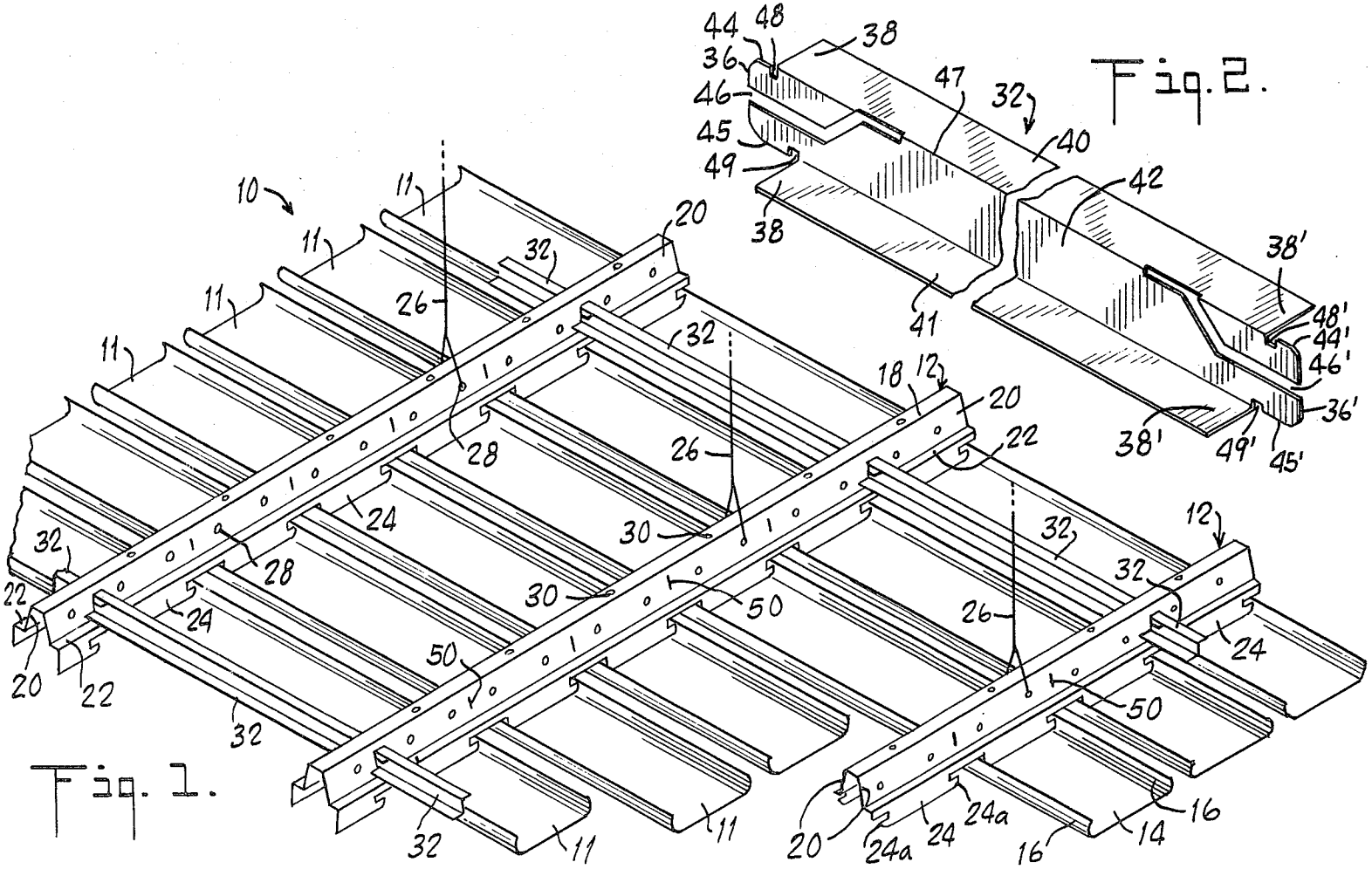
FIG. 1 is a fragmentary perspective view, from above, of a suspended ceiling assembly incorporating an illustrative embodiment of the invention.
FIG. 2 is an enlarged fragmentary perspective view of one of the stabilizer bars of the FIG. 1 assembly.

Referring to the drawings, the invention will be described as incorporated in a generally conventional suspended ceiling assembly 10 (FIG. 1) comprising a parallel array of ceiling panels 11 carried by a plurality of stringers 12 which are suspended from a structural ceiling (not shown) so that the panels are disposed with their downwardly-facing surfaces lying in a common horizontal plane spaced below the structural ceiling. In this assembly each of the panels 11 is an elongated, axially rectilinear, roll-formed, resiliently deformable sheet metal (e.g. aluminum or aluminum alloy) member having a flat central web 14 and opposed longitudinal edges 16 that curve upwardly and inwardly toward each other, the panel thus having an upwardly-opening C-shaped profile. Each of the stringers 12 is an elongated, axially rectilinear, roll-formed downwardly opening sheet metal channel member having the cross-sectional configuration sometimes termed a "hat section"; i.e. the stringer has a relatively narrow central horizontal web portion 16, from the opposite sides of which two sloping longitudinal flat web portions 20 diverge downwardly with their major surfaces oriented at small acute angles to the vertical, the lower ends of the web portions 20 being bent outwardly into a horizontal plane and then downwardly into vertical planes to provide two spaced parallel mounting flanges 22. The vertical portion of each flange 22 is cut out to form, along its length, a succession of horizontally spaced coplanar seats 24 each of which is a downward projection having opposed lateral prongs 24*a* shaped and arranged to be gripped by the opposed curved edges 16 of one of the panels 11. The seats 24 thus formed on the two mounting flanges 22 of each stringer are in register with each other, to provide a pair of spaced seats for each panel carried by the stringer.

The stringers 12 of the assembly 10 are suspended, with their long dimensions extending horizontally, in spaced parallel relation to each other (e.g. about four feet apart) at a common elevation some distance below the structural ceiling. As illustrated, each stringer can be suspended by a plurality of wires 26 located at spaced intervals along its length and passed through holes 28 provided in the sloping web portions 20 of the stringer, the upper end of each wire being secured to a suitable anchoring element (not shown) in the structural ceiling; alternatively, the stringers could be suspended by rods (not shown) anchored to the structural ceiling at their upper ends and connected at their lower ends to the stringers through holes 30 provided in the web portions 18 of the stringers. In either case, each stringer is individually suspended, i.e. separately from the other stringers, and (unless restrained) has some freedom of lateral and angular movement relative to the other stringers and to the structural ceiling.

The stringers are aligned so that their paired seats 24 are all in register, to enable each panel to engage the seats of plural stringers, each stringer being engaged by plural panels mounted side by side on adjacent pairs of seats. Ordinarily the panels are installed from beneath one by one, after the stringers are suspended, by snap-fitting the panel side edges 16 over the seat prongs 24*a*. Assuming maintained proper alignment of the stringers, the panels of the completed assembly extend transversely beneath (i.e. at right angles to) the stringers, in closely spaced coplanar parallel array with narrow gaps between adjacent panels, substantially concealing the stringers as viewed from below and providing an aesthetically pleasing subceiling. If desired, the gaps between adjacent panels may be closed by suitable filler strips (not shown). It will be understood that the panels, and also the stringers, may each be many feet long, and may each be constituted of plural sections disposed end to end.

From the foregoing description, it will be apparent that if any of the stringers becomes misaligned, as by deviating from parallelism with the other stringers or undergoing angular displacement, installation of the panels may be difficult or impossible, and already-installed panels may be deformed, dislodged, or at least displaced out of desired parallelism. Owing to the individual suspension of the stringers, such misalignment can occur from various causes, including racking. The structural features of the present invention, in the embodiment now to be described, serve to prevent misalignment of the stringers or racking of the assembly.

In accordance with the invention, as incorporated in the assembly 10, there are provided a plurality of stabilizer bars 32 each interconnecting two adjacent stringers 12 (above the level of the panels 11), the number of bars 32 in the assembly being sufficient so that each two adjacent stringers are interconnected by at least two of the bars. Each of the stabilizer bars (FIG. 2) is a rigid, elongated, axially rectilinear element dimensioned to extend between two adjacent stringers 12. Interlocking means comprising planar tabs 36, 36' are respectively formed at the opposite ends of the bar for snap-fittingly engaging the two stringers, and means comprising pairs of flanges 38, 38' are respectively formed adjacent the opposite ends of the bar for bearing against surfaces of the two stringers, upon engagement of the interlocking means with the stringers, to prevent angular movement of the stringers relative to the bar 32.

More particularly, as shown in FIGS. 2 and 7, each stabilizer bar is a unitary formed metal bar having a pair of vertically spaced horizontal longitudinal flanges 40, 41 and a vertical planar web 42 extending between and integral with the flanges; in the illustrated embodiment, flanges 40 and 41 respectively extend from opposite sides of the web 42, so that the bar 32 is Z-shaped in cross-section. At each end of the bar, the vertical web projects longitudinally beyond the ends of the flanges 40 and 41. These opposed projecting portions of the web 42 respectively constitute the planar tabs 36 and 36'; the end portions of the flanges 40 and 41 adjacent the tab 36 cooperatively constitute the pair of flanges 38 and the opposite end portions of the flanges 40 and 41 (adjacent the tab 36') cooperatively constitute the pair of flanges 38'.

The tab 36 has opposite (top and bottom) side edges respectively designated 44 and 45, the vertical dimensions of the tab between these edges being referred to hereinafter as the width of the tab. Intermediate the edges 44 and 45, the tab 36 is bifurcated (i.e. divided into upper and lower portions) by an open-ended slot 46 which extends horizontally inwardly (i.e. toward the center of the bar 32) from the extremity of tab 36, past the end portions 38 of the flanges 40 and 41, then extends diagonally upwardly and inwardly to the juncture 47 between web 42 and flange 40, and then extends further horizontally inwardly for a short distance along the juncture 47. A pair of oppositely opening notches 48 and 49 are respectively formed in the tab side edges 44 and 45 immediately adjacent the transverse end edges of the flange portions 38; as hereinafter further explained, the lower notch 49 is offset horizontally toward the center of the bar 32 with respect to the upper notch 48, but the vertical component of the distance between notches 48 and 49 is somewhat less than the width of the tab 36, i.e. between edges 44 and 45. The transverse end edges of the two flange end portions 38 adjacent the tab 36 are both extended rectilinear horizontal edges perpendicular to the major surface planes of the vertical web 42, the lower one of these edges being horizontally offset (with respect to the upper one of these edges) toward the center of the bar 32 in correspondence with the above-described offsetting of the lower notch 49 with respect to the upper notch 48.

Owing to the provision of the slot 46, the tab 36 and the adjacent portion of the bar 32 are resiliently compressible in a vertical direction to reduce the width of the tab. In the uncompressed condition, the slot 46 is of substantial width, i.e. metal of the web 42 is removed in forming the slot, so that such reduction in tab width can be accomplished without overlapping of the upper and lower portions of the tab and indeed without deviation of these tab portions from a common vertical plane. The specific described configuration of the slot 46, i.e. extending to and along the juncture 47, enables such width-reducing compression of the tab to be effected by manual pressure on the flange end portions 38; upon release of these flange end portions from manual pressure, the resilience of the metal forming the bar 32 restores the tab 36 to its original uncompressed width.

As further seen in FIG. 2, the tab 36' at the other end of the bar 32, and the associated flange end portions 38', are formed and arranged in the same manner as the tab 36 and the flange end portions 38. Thus, tab 36' is bifurcated by a slot 46' which ultimately extends upwardly to and then along the juncture 47 as a mirror image of the slot 46; the edges 44' and 45' of tab 36' respectively have notches 48' and 49' formed therein, the lower notch 49' being offset horizontally inwardly with respect to the upper notch 48'. The flange end portions 38' have horizontally extending rectilinear transverse edges perpendicular to the plane of web 42, spaced apart vertically by the height of web 42, and having relative horizontal positions corresponding to the horizontal positions of notches 48' and 49'. The uncompressed width of tab 36' is identical to that of tab 36.

As best seen in FIGS. 1 and 6, one of the sloping flat web portions 20 of each stringer 12 in the assembly 10 faces one of the sloping flat web portions 20 of the next adjacent stringer on one side, and the other sloping flat web portion 20 faces a sloping flat web portion of the next adjacent stringer on the other side of the first-mentioned stringer. Further in accordance with the invention, closed-ended slots 50 are formed at horizontally spaced locations along each flat web portion 20 of each stringer (FIG. 3) for receiving a tab 36 or 36' of a stabilizer bar 32. Each slot 50 extends transversely of the web portion 20 in which it is formed; i.e. the long dimension of each slot 50 lies in a vertical plane perpendicular to the long dimension of the stringer 12. All the slots 50 have an identical predetermined length, the term "length" being used in this context to refer to the vertical distance between the horizontal planes respectively containing the opposite ends 51 and 52 of the slot. This predetermined length is less than the width (as defined above) of one of the stabilizer bar tabs 36 and 36' but is equal to or slightly greater than the vertical component of distance between the notches 48 and 49 (or 48' and 49') of one of those tabs. The disposition of the slots 50 in the stringer web portions 20 is such that the slots of adjacent stringers are in register, i.e. with respective slots of any two adjacent stringers aligned in a vertical plane that contains the long dimensions of the slots and is perpendicular to the long dimensions of the two stringers.

Figures 3, 4, 5:
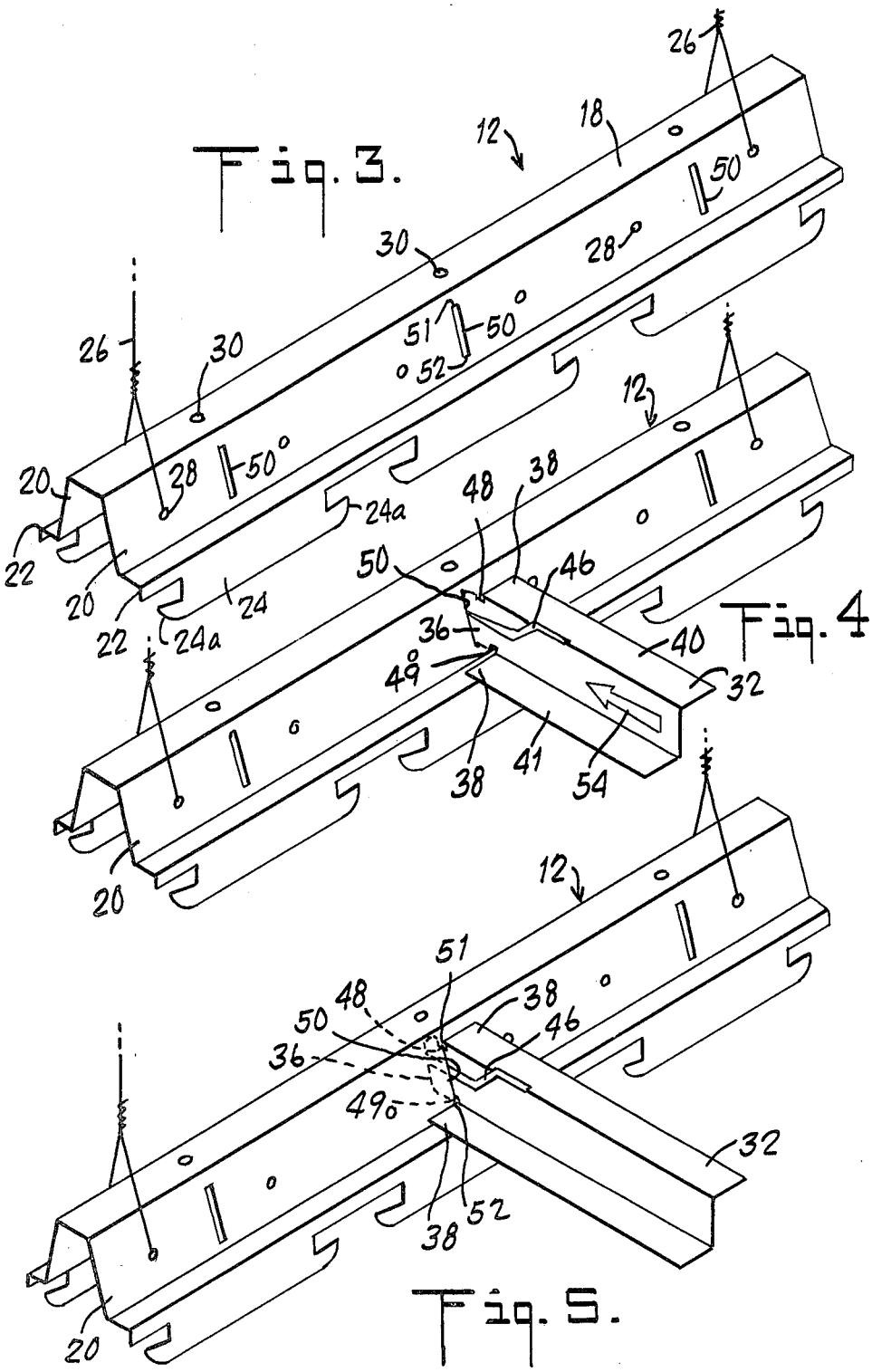
FIG. 3 is an enlarged fragmentary perspective view of one of the stringers of the FIG. 1 assembly.
FIGS. 4 and 5 are views similar to FIG. 3 illustrating successive stages in the installation of one of the stabilizer bars.

The interconnection of the stabilizer bars 32 with the stringers 12 may now be readily understood. As shown in FIG. 4, a stabilizer bar 32 is initially positioned adjacent a suspended stringer 12 with the tab 36 at one end of the bar 32 positioned for insertion in one of the slots 50. By manual pressure, the tab 36 is compressed to reduce its width to a value less than the predetermined length of the slot 50, the vertical dimension of the tab slot 46 being sufficient to permit this extent of tab compression, and the tab is inserted into the slot 50 by moving the stabilizer bar relative to the stringer in the direction indicated by arrow 54 until the transverse end edges of the flange edge portions 38 abut the facing surface of the stringer web portion 20. At this point, the tab 36 is released from compression so that the upper and lower tab portions spring apart, restoring the tab to its original width (FIG. 5). Thus the tab 36 snap-fittingly engages the flat web portion 20 of the stringer 12 at the opposite ends of the slot 50 to interlock the stabilizer bar therewith.

As will now be appreciated, the tab notches 48 and 49 respectively constitute side edge portions of the tab for engaging the stringer web portion 20 at the top and bottom ends of the slot 50 when the tab is inserted as described above and then released from compression. That is to say, the location of these notches 48 and 49 relative to each other is such that upon full insertion of the tab and release of the tab from compression, the upper tab notch 48 and the lower tab notch 49 simultaneously fit over the opposite ends of the slot 50, and the portion of the tab beyond the notches (having been restored to its original width) prevents withdrawal of the tab from the slot 50, the widths of the notches 48 and 49 being just sufficient to accommodate the thickness of the flat wall portion 20 at the angle at which it is engaged by the notches.

As stated, the transverse end edges of the flange end portions 38 are so located in relation to the tab notches and to each other that they simultaneously bear against the facing surfaces of the stringer web portion 20, along extended, vertically spaced horizontal lines of contact respectively adjacent the top and bottom of the slot 50, upon full insertion of the tab 36 into the slot 50 and release of the tab from compression. This extended abutting contact of the flange end portions with the stringer prevents angular movement of the stringer relative to the stabilizer bar, while the notched tab interlockingly engaging the stringer web portion at the slot 50 prevents longitudinal movement of the stabilizer bar relative to the stringer.

When a stabilizer bar 32 is interlocked at one end with a stringer as shown in FIGS. 4 and 5, its other end is located in immediate proximity to a slot 50 of a facing flat web portion of an immediately adjacent stringer. The installation process just described is repeated to interlock the tab 36' at the second end of the stabilizer bar with its adjacent stringer, so that the stabilizer bar interconnects the two stringers as shown in FIG. 6, being then disposed above the level of the panels 11 with its long dimension extending perpendicularly to the long dimensions of the stringers.

In the installation of an assembly 10 incorporating the stabilizer bars 32, as will be appreciated, the stabilizer bars are conveniently mounted between the stringers prior to attachment of the panels. Once at least two stabilizer bars have been installed between two adjacent stringers, at spaced locations along the length of the stringers, they hold those stringers against any substantial deviation from parallelism with each other, because they are so interlocked with the stringers that no longitudinal movement of the stabilizer bars relative to the stringers can occur. At the same time, the engagement of the stabilizer bar flange end portions 38 and 38' with the stringers prevents any significant angular movement of the stringers relative to each other because neither stringer can move angularly relative to the stabilizer bars. When the complete assembly of stringers 12 is thus interconnected by stabilizer bars 32, this inhibition of angular movement of the stringers prevents racking of the assembly as well as individual angular displacement of any one of the stringers, even under an eccentric load; and the stabilizer bars, as well as the stringers, can be used for support of such loads as light fixtures or diffusers.

The stabilizer bars of the invention, in the described embodiment, can be readily fabricated from flat metal strip of appropriate gauge by generally conventional forming and cutting techniques. Moreover, the stringers of a conventional ceiling assembly of the type shown at 10 in FIG. 1 can be adapted for use of the stabilizer bars therewith by simply forming appropriately positioned slots 50 in their flat web portions 20. Installation of the stabilizer bars is very easily accomplished, involving (as set forth above) manual compression of the tabs, insertion thereof in the slots 50 (which, of course, have a width greater than the gauge of the tabs), and release of the fully inserted tabs from compression when the rotation-preventing flange end portions 38 or 38' abut the surface of the stringer web portion.

It is to be understood that the invention is not limited to the features and embodiments hereinabove specifically set forth but may be carried out in other ways without departure from its spirit.

We claim:

1. A stabilizer bar for interconnecting two adjacent ones of a plurality of spaced, elongated stringers in a suspended ceiling assembly wherein the stringers are individually suspended and cooperatively carry an array of ceiling panels, and wherein each of said two adjacent stringers has a longitudinally extending flat web portion facing the other of said two stringers, said stabilizer bar comprising (a) a rigid elongated element having opposed ends and dimensioned to extend between the two stringers such that the stringers are respectively disposed at said ends;

(b) first and second interlocking means respectively formed at the ends of said element for respectively snap-fittingly engaging the two stringers to hold the element against longitudinal movement relative to the stringers; and (c) first and second means respectively formed adjacent the ends of said element for respectively bearing against the two stringers, upon engagement of the interlocking means with the stringers, to prevent relative angular movement of the stringers and the element and thereby, in cooperation with other like stabilizer bars interconnecting stringers of the assembly, to maintain the stringers fixed in orientation relative to each other and to prevent racking of the assembly, (d) each of said bearing means comprising a pair of flanges respectively having edges disposed to simultaneously abut a surface of the web portion of one of said two stringers, along extended lines of contact spaced transversely of the length of the stringer, upon snap-fitting engagement of the adjacent one of said interlocking means with said one stringer.

2. A stabilizer bar for interconnecting two adjacent ones of a plurality of spaced, elongated stringers in a suspended ceiling assembly wherein the stringers are individually suspended and cooperatively carry an array of ceiling panels, and wherein each of said two adjacent stringers has a longitudinally extending flat web portion facing the other of said two stringers, with transversely extending closed-ended slots of predetermined length formed in the web portions, said stabilizer bar comprising (a) a rigid elongated element having opposed ends and dimensioned to extend between the two stringers such that the stringers are respectively disposed at said ends;

(b) first and second interlocking means respectively formed at the ends of said element for respectively snap-fittingly engaging the two stringers to hold the element against longitudinal movement relative to the stringers; and (c) first and second means respectively formed adjacent the ends of said element for respectively bearing against the two stringers, upon engagement of the interlocking means with the stringers, to prevent relative angular movement of the stringers and the element and thereby, in cooperation with other like stabilizer bars interconnecting stringers of the assembly, to maintain the stringers fixed in orientation relative to each other and to prevent racking of the assembly, (d) each of said interlocking means comprising a bifurcated planar tab insertable in one of said slots with the width of the tab aligned with the slot length, the tab being resiliently compressible from an uncompressed width greater than said predetermined length to a compressed width permitting insertion of the tab into one of said slots, the tab having opposed side edge portions for respectively engaging opposite ends of one of said slots, upon insertion of the tab therein and release of the inserted tab from compression, to lock the tab in the slot, and (e) each of said bearing means comprising a pair of flanges respectively having edges disposed, adjacent said opposed side edge portions of one of the tabs, to simultaneously abut a surface of one of said stringer web portions adjacent opposite ends of one of said slots, along spaced extended lines of contact extending transversely of the length of the slot, upon insertion and locking of said one tab in said one last-mentioned slot.

3. A stabilizer bar for interconnecting two adjacent ones of a plurality of horizontally elongated stringers in a suspended ceiling assembly wherein the stringers are individually suspended at a common elevation in spaced, parallel relation to each other and cooperatively carry an array of ceiling panels, each of the stringers having at least one flat web portion oriented at a substantial angle to the horizontal and extending longitudinally above the panels with closed-ended slots of predetermined length formed in each of the web portions and so disposed that respective slots of said two adjacent stringers are aligned in a vertical plane that contains their long dimensions and is perpendicular to the long dimensions of said two stringers, said stabilizer bar comprising:

(a) a rigid, elongated, axially rectilinear element having opposed ends and dimensioned to extend between said two stringers such that aligned respective slots of said two stringers are respectively disposed at the ends of the element;

(b) a pair of tabs, respectively formed at the opposed ends of the element and integral therewith, for respectively interlocking the element with said two stringers to prevent longitudinal movement of the element relative to said two stringers, each of said tabs being snap-fittingly insertable into a stringer slot disposed at the end of the element at which the tab is formed; and, (c) adjacent each end of said element, a pair of flanges formed integrally therewith and respectively having edges disposed to simultaneously abut the flat web portion of a stringer having a slot disposed at that end of the element, along vertically spaced lines of contact extending transversely of the last-mentioned stringer slot, upon snap-fitting insertion of the tab formed at that end of the element into the last-mentioned slot, for preventing relative angular movement of said two stringers and said element, thereby, in cooperation with other like stabilizer bars interconnecting stringers of the assembly, to maintain the parallelism of the stringers and to prevent racking of the assembly.

4. A stabilizer bar as defined in claim 3, wherein said element comprises a pair of vertically spaced horizontal longitudinal flanges each having opposite ends and a vertical planar web extending between said integral with said flanges, said vertical web having opposed end portions respectively projecting longitudinally beyond the opposite ends of said flanges, each projecting portion of said vertical web constituting one of said tabs and being bifurcated so as to be resiliently compressible from an uncompressed vertical width greater than said predetermined length of one of said slots to a compressed vertical width permitting insertion of the tab into one of said slots, each of the tabs having opposed side edge portions for respectively engaging opposite ends of one of said slots, upon insertion of the tab therein and release of the tab from compression, to lock the tab in the slot; and wherein said pair of flanges formed adjacent each end of the element comprises end portions of said pair of horizontal longitudinal flanges.

5. A stabilizer bar as defined in claim 4, wherein each of said projecting potions of said vertical web is bifurcated by a slot extending horizontally inwardly from the extremity of the projecting portion, lengthwise of the element, then extending diagonally and inwardly to a juncture between said vertical web and one of said horizontal flanges, and then horizontally inwardly along the last-mentioned juncture, such that the tab constituted by the projecting portion is compressible as aforesaid by manual pressure exerted on said horizontal flanges adjacent the projecting portion.

6. A stabilizer bar as defined in claim 5, wherein said opposed side edge portions of each tab are oppositely opening notches respectively formed in opposed side edges of the tab for respectively receiving opposite ends of one of said slots when the tab, inserted therein, is released from compression.

7. A stabilizer bar as defined in claim 5, wherein said element is a formed unitary metal bar having a Z-shaped cross-section.

8. A suspended ceiling assembly comprising (a) an array of ceiling panels;

(b) a plurality of individually suspended, spaced, elongated stringers cooperatively carrying said array of panels, each of said strongers having a longitudinally extending flat web portion facing an adjacent other one of said stringers; and (c) a plurality of stabilizer bars interconnecting stringers of the assembly for maintaining the stringers fixed in orientation relative to each other and for preventing racking of the assembly, each of said stabilizer bars interconnecting two adjacent ones of said stringers, and each two adjacent strippers being connected by at least two of said stabilizer bars, (d) each of said stabilizer bars comprising (i) a rigid elongated element having opposed ends and dimensioned to extend between two adjacent stringers such that the two last-mentioned stringers are respectively disposed at said ends;

(ii) first and second interlocking means respectively formed at the ends of said element for respectively snap-fittingly engaging the two last-mentioned stringers to hold the element against longitudinal movement relative thereto; and (iii) first and second means respectively formed adjacent the ends of said element for respectively bearing against the two last-mentioned stringers, upon engagement of the interlocking means with the last-mentioned stringers, to prevent relative angular movement of the stringers and the element, each of said bearing means comprising a pair of flanges respectively having edges disposed to simultaneously abut a surface of the web portion of one of said stringers, along extended lines of contact spaced transversely of the length of the stringer, upon snap-fitting engagement of the adjacent one of said interlocking means with said one stringer.

9. A suspended ceiling assembly comprising (a) an array of ceiling panels;

(b) a plurality of individually suspended, spaced, elongated stringers cooperatively carrying said array of panels, each of said stringers having a longitudinally extending flat web portion facing an adjacent other one of said stringers, with transversely extending closed-ended slots of predetermined length formed in the web portion of each stringer; and (c) a plurality of stabilizer bars interconnecting stringers of the assembly for maintaining the stringers fixed in orientation relative to each other and for preventing racking of the assembly, each of said stabilizer bars interconnecting two adjacent ones of said stringers, and each two adjacent stringers being connected by at least two of said stabilizer bars, (d) each of said stabilizer bars comprising (i) a rigid elongated element having opposed ends and dimensioned to extend between two adjacent stringers such that the two last-mentioned stringers are respectively disposed at said ends;

(ii) first and second interlocking means respectively formed at the ends of said element for respectively snap-fittingly engaging the two last-mentioned stringers to hold the element against longitudinal movement relative thereto, each of said interlocking means of each stabilizer bar comprising a bifurcated planar tab insertable in one of said slots with the width of the tab aligned with the slot length, the tab being resiliently compressible from an uncompresed width greater than said predetermined length to a compressed width permitting insertion of the tab into one of said slots, the tab having opposed side edge portions for respectively engaging opposite ends of one of said slots, upon insertion of the tab therein and release of the inserted tab from compression, to lock the tab in the slot; and (iii) first and second means respectively formed adjacent the ends of said element for respectively bearing against the two last-mentioned stringers, upon engagement of the interlocking means with the last-mentioned stringers, to prevent relative angular movement of the stringers and the element, each of said bearing means comprising a pair of flanges respectively having edges disposed, adjacent said opposed side edge portions of one of the tabs, to simultaneously abut a surface of one of said stringer web portions adjacent opposite ends of one of said slots, along spaced extended lines of contact extending tranversely of the length of the slot, upon insertion and locking of said one tab in said one last-mentioned slot.

10. A ceiling assembly as defined in claim 9, wherein the stringers are oriented with their long dimensions horizontal and individually suspended at a common elevation in parallel relation to each other; wherein said flat web portions of the stringers are oriented at a substantial angle to the horizontal and extend longitudinally above the panels; wherein said closed-ended sots are so disposed that respective slots of two adjacent stringers are aligned in a vertical plane that contains the long dimensions of the slots and is perpendicular to the long dimensions of said two stringers; wherein said element of each stabilizer bar is rectilinear and is dimensioned to extend between two adjacent stringers such that aligned respective slots of said two stringers are respectively disposed at the ends of the element; wherein each of said tabs is snap-fittingly insertable into a stringer slot disposed at the end of the element at which the tab is formed; and wherein said lines of contact are vertically spaced.

11. A ceiling assembly as defined in claim 10, wherein said element of each stabilizer bar comprises a pair of vertically spaced horizontal longitudinal flanges each having opposite ends and a vertical planar web extending between and integral with said flanges, said vertical web having opposed end portions respectively projecting longitudinally beyond the opposite ends of said flanges, each projecting portion of said vertical web constituting one of said tabs and being bifurcated by a slot extending horizontally inwardly from the extremity of the projecting portion, lengthwise of the element, then extending diagonally and inwardly to a juncture between said vertical web and one of said horizontal flanges, and then horizontally inwardly along the last-mentioned juncture, such that the tab constituted by the projecting portion is compressible as aforesaid by manual pressure exerted on said horizontal flanges adjacent the projecting portion; and wherein said pair of flanges formed adjacent each end of the element comprises end portions of said pair of horizontal longitudinal flanges.

12. A ceiling assembly as defined in claim 11, wherein said opposed side edge portions of each tab are oppositely opening notches respectively formed in opposed side edges of the tab for respectively receiving opposite ends of one of said slots when the tab, inserted therein, is released from compression.

13. A ceiling assembly as defined in claim 11, wherein said element is a formed unitary metal bar having a Z-shaped cross-section.

* * * * *